US008850736B2

(12) United States Patent
Klotz et al.

(10) Patent No.: US 8,850,736 B2
(45) Date of Patent: Oct. 7, 2014

(54) STOCK MOUNTING DEVICE FOR A SMALL ARM

(71) Applicant: J.P. Sauer & Sohn GmbH, Isny (DE)

(72) Inventors: Matthias Klotz, Gestratz (DE); Bastian Rothe, Weitnau-Kleinweiler (DE)

(73) Assignee: J.P. Sauer & Sohn GmbH, Isny (DE)

( * ) Notice: Subject to any disclaimer, the term of this patent is extended or adjusted under 35 U.S.C. 154(b) by 99 days.

(21) Appl. No.: 13/644,116

(22) Filed: Oct. 3, 2012

(65) Prior Publication Data

US 2013/0081316 A1 Apr. 4, 2013

(30) Foreign Application Priority Data

Oct. 4, 2011 (DE) ..... 10 2011 114 687

(51) Int. Cl.
*F41A 21/00* (2006.01)
*F41C 23/00* (2006.01)
*F41C 23/16* (2006.01)

(52) U.S. Cl.
CPC ..... *F41C 23/00* (2013.01); *F41C 23/16* (2013.01)
USPC ..... 42/75.03; 42/75.01; 24/457; 24/503; 24/505; 24/506; 24/517

(58) Field of Classification Search
USPC ..... 42/75.03, 75.01; 24/457, 503, 505, 506, 24/517
See application file for complete search history.

(56) References Cited

U.S. PATENT DOCUMENTS

| | | | | |
|---|---|---|---|---|
| 6,886,286 | B2 * | 5/2005 | Dowding | 42/75.03 |
| 6,889,463 | B2 * | 5/2005 | Orth | 42/75.03 |
| 2010/0132240 | A1 * | 6/2010 | Webber et al. | 42/75.03 |
| 2012/0042556 | A1 * | 2/2012 | Vesligaj | 42/75.03 |

FOREIGN PATENT DOCUMENTS

| | | | |
|---|---|---|---|
| DE | 126968 | A1 | 8/1977 |
| DE | 202006001486 | U1 | 5/2006 |

* cited by examiner

*Primary Examiner* — J. Woodrow Eldred
(74) *Attorney, Agent, or Firm* — Fleit Gibbons Gutman Bongini & Bianco PL; Martin Fleit; Paul D. Bianco

(57) ABSTRACT

The invention relates to a stock mounting device for fixing a stock on a receiver of a small arm that includes a clamping pin, and a clamping cam cooperating with the clamping pin, by which the shank can be mounted on the receiver by generating an axial force.

11 Claims, 6 Drawing Sheets

STOCK MOUNTING DEVICE FOR A SMALL ARM

CROSS REFERENCE TO RELATED APPLICATION

This application claims priority under 35 U.S.C. §119 to German Patent Application No. 10 2011 114 687.7 filed Oct. 4, 2011, the entire contents of which are incorporated herein by reference.

FIELD OF THE INVENTION

The invention relates to stock mounting device for a small arm. The invention further relates to a small arm with such a stock mounting device.

BACKGROUND OF THE INVENTION

In previously known small arms, the stocks, typically consisting of wood or plastic, are generally fixed to the action or receiver by means of special threaded screws. One disadvantage of this mounting is that several turns of the threaded screws are required in order to mount or detach the barrel, which is connected with a corresponding expenditure of time and assembly work. The threaded screws can also be lost while in use.

SUMMARY OF THE INVENTION

One object of the invention is to create a stock mounting device and a small arm with such a stock mounting device that allow easy and fast mounting or detachment of a stock.

This problem is solved by a stock mounting device as set forth herein and by a small arm with the characteristics as also set forth herein. Expedient configurations and advantageous refinements of the invention are also disclosed.

The stock mounting device according to the invention consists of a clamping pin and a clamping cam cooperating with the clamping pin, by means of which the stock can be mounted on the receiver by generating an axial tensile force. The clamping cam comprises a central though-hole for passage of a tensioning head of the clamping pin and at least one lateral slot for receiving a slimmer area of the clamping pin. Thereby the clamping pin can be pushed through the clamping cam and the clamping cam can be rotated into a clamping position. A quick-release fastener that allows fast and secure mounting and dismounting of the stock without laborious assembly work is made possible by the clamping cam and the associated clamping pin. In comparison to the usual mounting screws, the clamping cam need only be rotated by one quarter turn in order to effect clamping or releasing. A fixed clamped position can additionally be specified by the clamping cam, so that excessively weak or strong tightening of the stock and associated inaccuracies or warping can be avoided. In addition, the clamping cam and the clamping pin remain mounted on the parts to be connected even when the stock is released, so that they cannot be lost even during dismounting of the stock in the field.

In an advantageous configuration, the clamping pin is arranged on the receiver, and the clamping cam in the stock. In order to mount a front stock, for example, the clamping cam can be arranged in the front stock rotatably about an axis perpendicular to the longitudinal axis of the stock. The clamping cam is expediently accommodated on a baseplate inside a housing. The clamping cam can also be arranged in the stock without a separate housing, however.

The clamping cam preferably has at least one eccentric clamping face on its outer side for contacting a tightening face of the clamping pin. In this way, an axial retraction force can be generated between the clamping cam and the clamping pin. The clamping cam can also be constructed symmetrically, however, and have two opposing eccentric clamping faces and two opposing slots. Then it is not necessary to take account of any special installation position when mounting the clamping cam.

A locking device for preventing an undesired rotation of the clamping cam can be arranged on the clamping cam. For example, the clamping device can be an actuating element, form-fit to the clamping cam and axially movable between a locking position and an actuation position, that can only be rotated in the actuation position. This can be achieved in an expedient embodiment in that the actuating element has a head constructed as a hexagon and a slimmer shank located underneath the head, and runs through an opening constructed as a slotted hole of a baseplate in such a manner that the head is held secured against rotation in the locking position inside the opening, and in the actuating position, the shank moves into the area of the opening in order to rotate the actuation element.

In another expedient embodiment, the clamping pin can be mounted on the receiver via a mounting element. The mounting element can be arranged, pivotable between a stock mounting position and a barrel mounting position, in a slot of a barrel receptacle of the receiver constructed as a slotted sleeve, and can be constructed in the form of a wedge in such a manner the barrel receptacle is widened in the barrel-mounted position. Thereby the mounting element is not only able to take on the retention of the clamping pin, but can also take over the function of an installation aid for mounting and dismounting the barrel.

BRIEF DESCRIPTION OF THE DRAWINGS

Additional details and advantages of the invention emerge from the following description of a preferred embodiment with reference to the drawings. Therein.

DETAILED DESCRIPTION OF THE INVENTION

Figure 1:
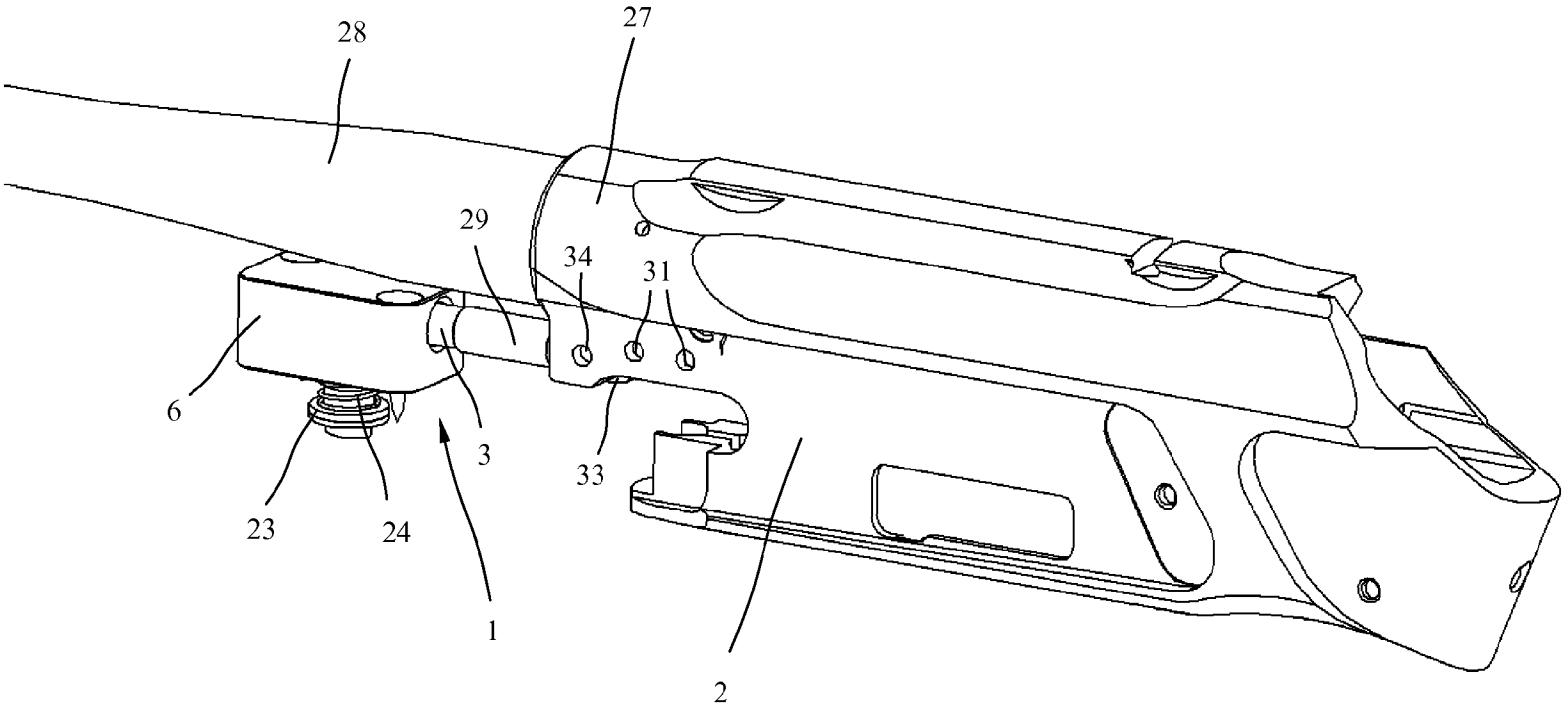
FIG. 1 illustrates a receiver of a repeating rifle with a stock mounting device according to the invention for fixing a front stock on the receiver.
Figure 2:
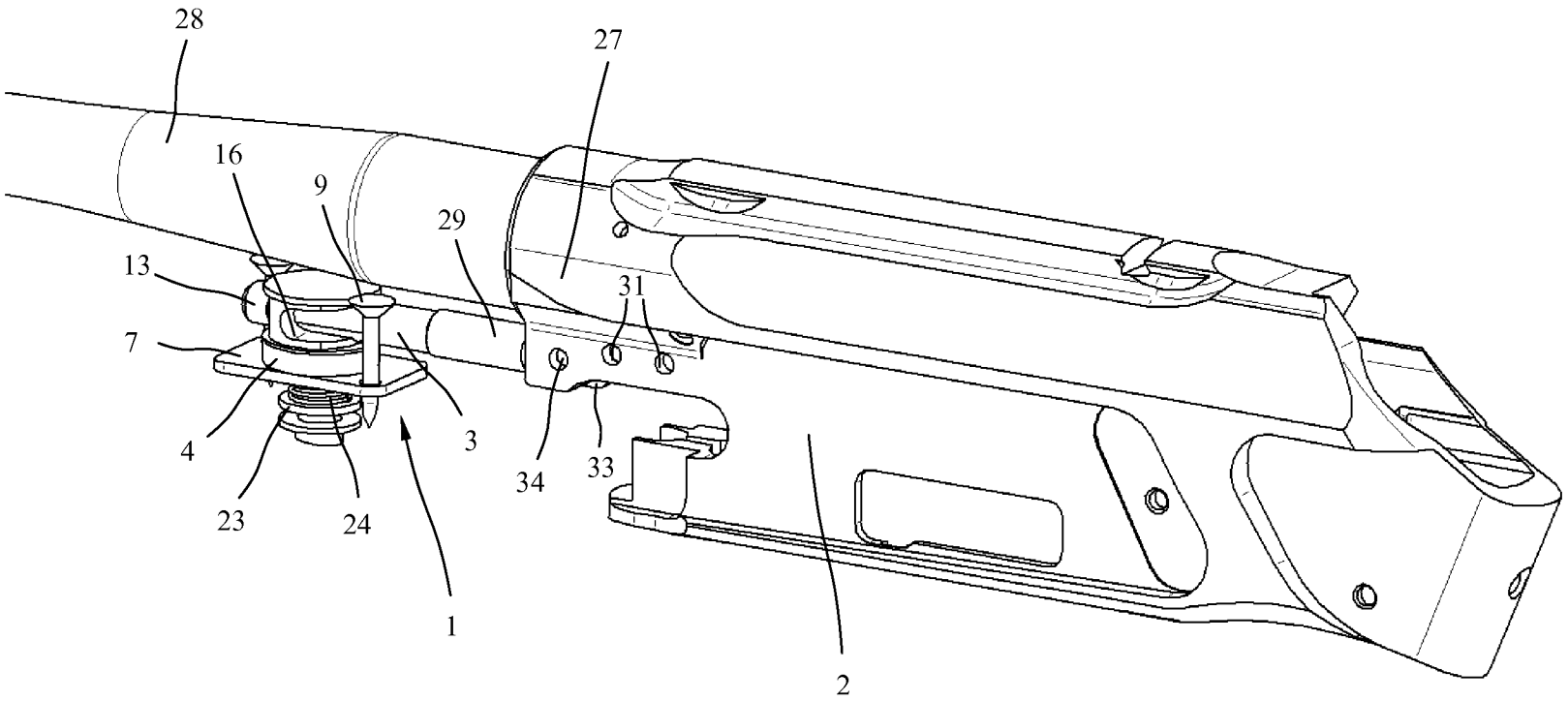
FIG. 2 illustrates the stock mounting device of FIG. 1 without its housing.
Figure 3:
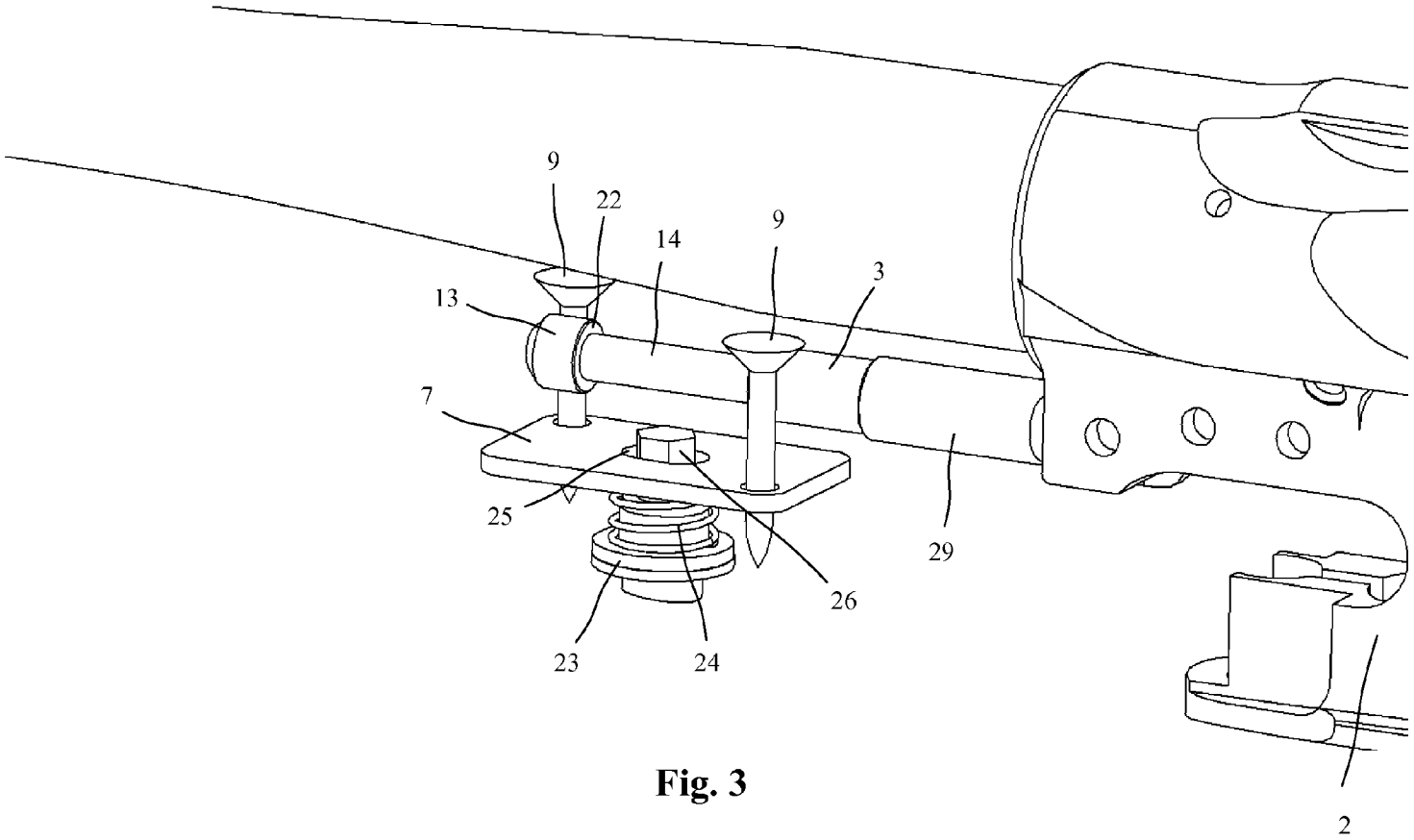
FIG. 3 illustrates a detail view of the stock mounting device with an actuating element in a locked position.
Figure 4:
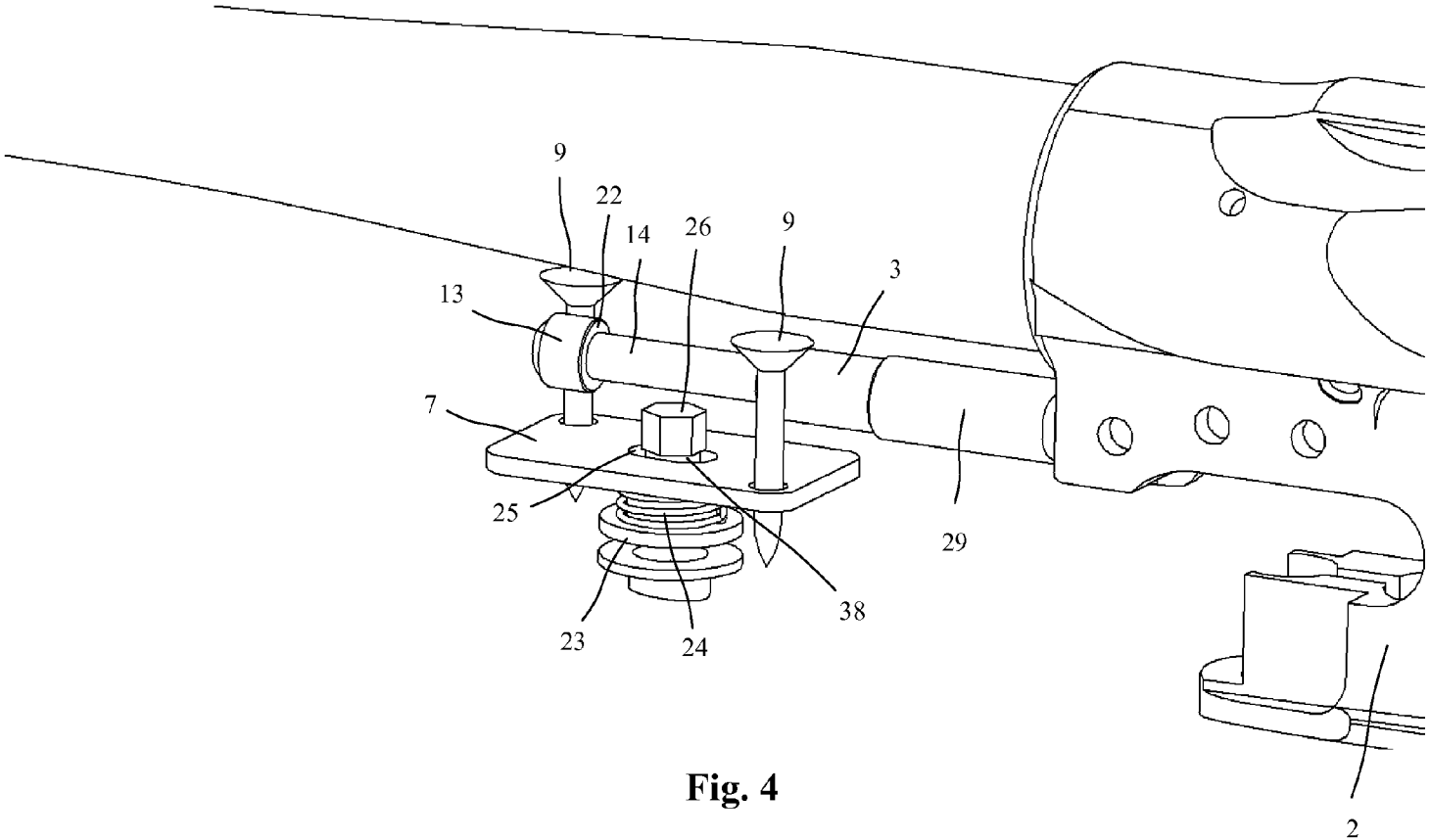
FIG. 4 illustrates a detail view of the stock mounting device with the actuating element in the actuation position.
Figure 5:
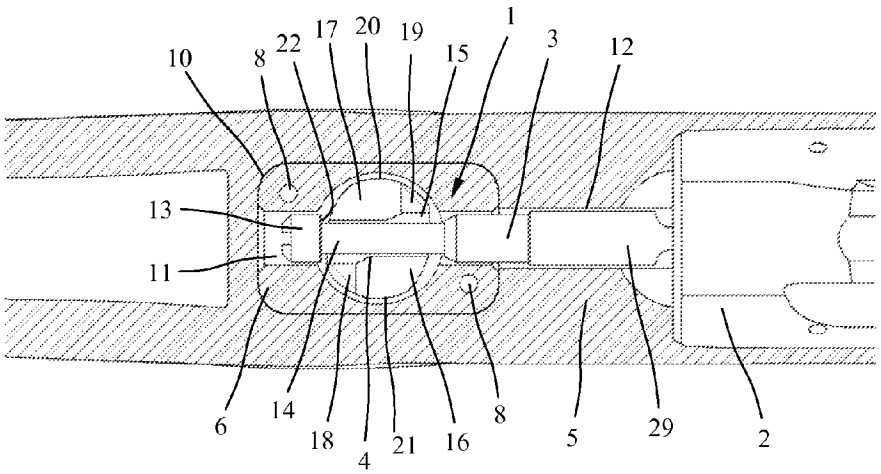
FIG. 5 illustrates the stock mounting device with a clamping cam in a releasing position in cross section.

The stock mounting device 1 shown in different views in FIGS. 1-6 contains a clamping pin 3 mounted on an action or receiver 2 of a repeating rifle and a clamping cam 4 in accordance with FIG. 2 that can be arranged according to FIG. 5, for example, in the front stock 5 of the repeating rifle. The front stock 5 can be fixed on the receiver 2 by means of the clamping pin 3 and the clamping cam 4.

Figure 6:
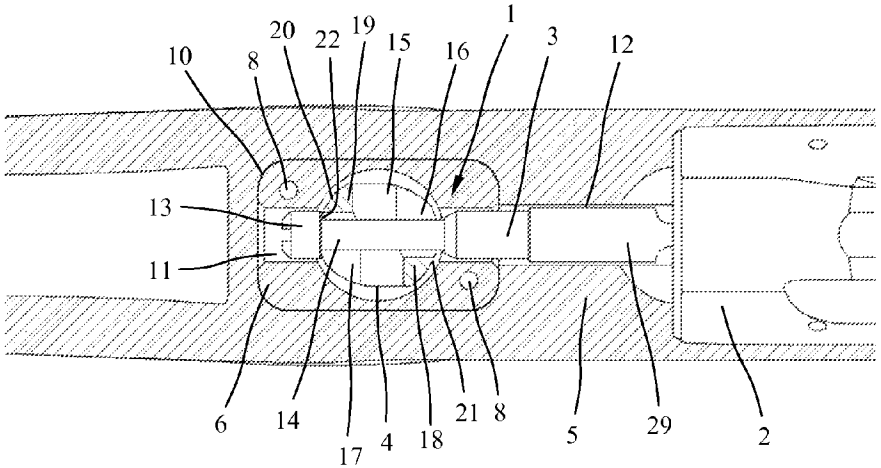
FIG. 6 illustrates the stock mounting device with the clamping cam of FIG. 5 in a releasing position in cross section.

As can be seen in FIGS. 5 and 6, the clamping cam 4 is arranged inside the front stock 5 rotatably about an axis perpendicular to the longitudinal axis of the stock 5. The clamping cam 4 is arranged inside a housing 6 on a base plate 7 recognizable in FIG. 2 so as to be rotatable between a released position shown in FIG. 5 and a clamping position shown in FIG. 6. The base plate 7 and the housing 6 with the clamping cam 4 arranged therein are mounted via holes 8 and screws 9 recognizable in FIG. 2 in a corresponding recess 10 of the front stock 5. A through-hole 11 for introducing the clamping pin 3 is provided in the housing 6.

A passage 12, aligned with the opening 11, for introducing the clamping pin 3 is also situated in the stock 5. The clamping pin 3 mounted at the front end of the receiver 2 is arranged in the assembled position so as to project forward in the direction of the longitudinal axis of the receiver 2, and has a tensioning head 13 at its front end and an adjoining slimmer area 14. In the clamped position shown in FIG. 6, the clamping pin 3 projects through the clamping cam 4 and the tensioning head 13 is opposite the clamping cam 4.

The clamping cam 4 shown in FIG. 2 and FIGS. 5 and 6 contains a central through-hole 15 running perpendicular to its axis of rotation and two diametrically opposed lateral slots 16 and 17 which extend up to a respective web 18 and 19. The through-hole 15 has a somewhat larger inside diameter than the outside diameter of the tensioning head 13, so that the tensioning head 13 can be pushed completely through the clamping cam 4. The slots 16 and 17 have a somewhat larger width than the slimmer area 14 on the clamping pin 3. The slots 16 and 17 are constructed in such a manner that the clamping cam 4 can be rotated by approx. 90° with clamping pin 3 inserted. On the outside of the clamping cam 4, at least one eccentric clamping face 20, spiral-shaped for example, is provided, which comes into contact with an inner tightening face 22 on the inner side of the tensioning head 13 in case of a rotation of the clamping cam 4 into the clamping position and generates an axial retraction force between the clamping pin 3 and the clamping cam 4.

In the embodiment shown, the clamping cam 4 is constructed symmetrically with two opposing clamping faces 20 and 21 and two lateral receptacle slots 16 and 17. Thereby the clamping cam 4 can be installed in two positions. The clamping cam 4, however, can also have only one clamping face 20 and one associated receptacle slot 16.

The clamping cam 4 is rotated by a bolt-like actuating element 23, rotatably arranged inside the stock 5 coaxially with the axis of rotation of the clamping cam 4 and movable axially, that can be moved axially against the force of a compression spring 24 between a lower locking position shown in FIG. 3 and an upper actuation position shown in FIG. 4. The actuation element 23, rotatable by an Allen wrench or another suitable tool, contains an upper part projecting through an opening 25 in the base plate 7 with a head 26 constructed as a hexagon and a slimmer cylindrical shank 38 below it, which is recognizable in FIG. 4.

In order to rotate the clamping cam 4, the hexagon-shaped head 26 positively engages in a recess shaped as a hexagon socket on the underside of the clamping cam 4. The opening 25 is constructed as a slotted hole with a width that is only slightly larger than the wrench size of the hexagon-shaped head 26. Thus, if the hexagon-shaped head 26 is in the area of the opening 25 in the baseplate 7, the actuating element 23 cannot be rotated. The slimmer shank 38 underneath the head 26 is arranged in such a manner that it only comes into the area of the opening 25, constructed as a slotted hole, of the baseplate 7 in case of a displacement of the actuating element 23 into the upper actuation position, and thereby allows turning of the clamping cam 4. On the other hand, if the actuating element 23 is pressed by the compression spring 24 into the lower locking position, the hexagonally shaped head 26 also comes into engagement with the opening 25 constructed as a slotted hole, whereby a rotation of the clamping cam 4 is prevented. The actuating element 23 must therefore be pushed in against the force of the compression spring 24 before the clamping cam 4 can be turned. This creates a locking device for preventing an undesired rotation of the clamping cam 4.

In the embodiment shown in the drawing, the action or receiver 2 has a barrel receptacle 27 constructed as a slotted sleeve for detachable retention of a barrel 28. The clamping pin 3 is connected via a bolt-like mounting element 29 to the receiver 2. As follows from the bottom views in FIGS. 7 and 8, the barrel receptacle 27 contains a slot 30 and lateral holes 31, visible in FIG. 1, via which the barrel receptacle 27 constructed as a slotted sleeve can be pressed together with the aid of clamping screws 32 to fix the barrel 28 in place. The mounting element 29 is arranged with its bilaterally flattened rear end 33 in the slot 30 so as to be rotatable about a transverse pin 34 recognizable in FIG. 1 between a stock mounting position illustrated in FIG. 7 and a barrel mounting position shown in FIG. 8.

Figure 7:
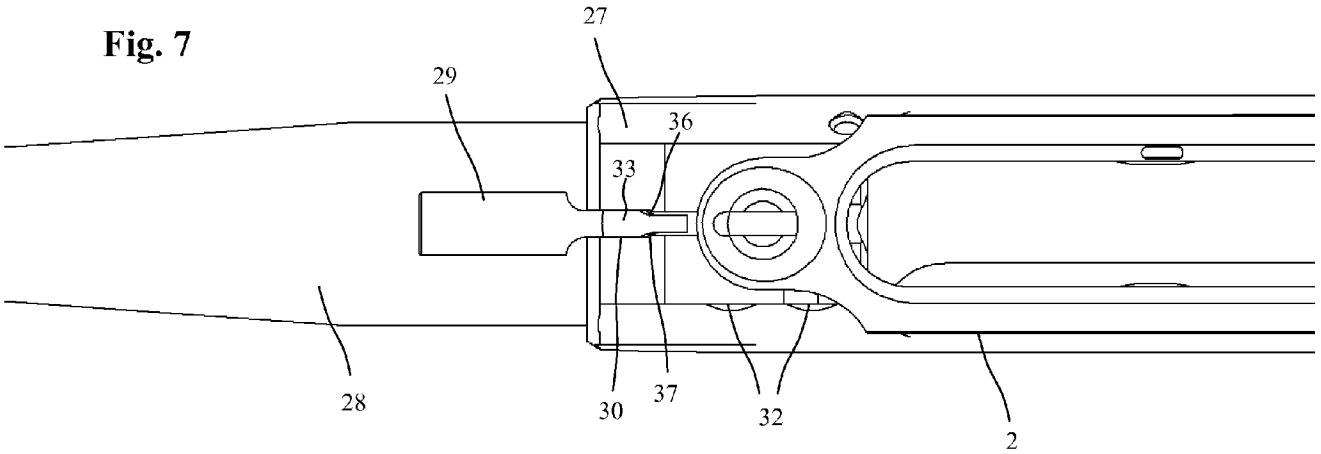
FIG. 7 illustrates a bottom view of a receiver with a mounting element for the stock mounting device in a stock mounting position.
Figure 8:
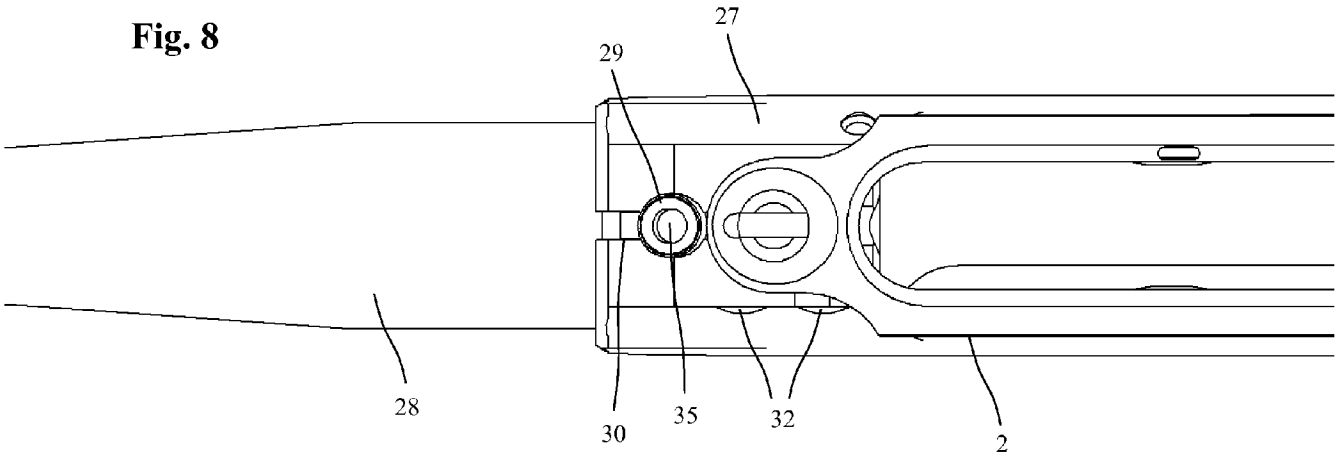
FIG. 8 illustrates a bottom view of the receiver with the mounting element for the stock mounting device in a barrel mounting position.

The clamping pin 3 is screwed tightly into a threaded hole 35, recognizable in FIG. 8, in the front end of the bolt-like mounting element 29. The flattened rear end 33 of the mounting element 29 is constructed like a wedge in such a manner that the barrel receptacle 27 is spread open for easier mounting or dismounting of the barrel 28 when the mounting element 29 is pivoted into the position of FIG. 8. To accomplish this, it is possible to provide, on the end 33 of the mounting element that is articulated in the slot 30, lateral wedge faces 36, as can be seen in FIG. 7, that, if the mounting element 29 is pivoted into the position of FIG. 8, come to rest against a step-like shoulder 37 between a wider outer area and a narrower inner area of the slot 30, and thereby spread open the barrel receptacle 27.

In the shank mounting position of FIG. 7, the mounting element 29 is oriented according to FIG. 1 in the longitudinal direction of the receiver 2, so that the clamping pin 3 fastened in the mounting element 29 can be introduced into the clamping cam 4 when the front stock 5 contacts the receiver 2. In the downward-pivoted barrel mounting position of FIG. 8, on the other hand, the barrel receptacle 27 is widened so that the barrel 28 can be more easily mounted and dismounted. The mounting element 29 therefore serves not only for retaining the clamping pin 3, but can also take on the function of an assembly aid for mounting and dismounting the barrel 28.

What is claimed is:

1. A stock mounting device for mounting a stock on a receiver for a small arm, the device comprising:

a clamping pin and a clamping cam that cooperates with the clamping pin, the clamping cam comprising a central through-hole for passage of a tensioning head of the clamping pin, the clamping cam further comprising at least one lateral slot for accommodating a slimmer area of the clamping pin; and a locking device configured for preventing an undesired turning of the clamping cam arranged on the clamping cam, the locking device including an axially movable actuating element, positively connected to the clamping cam, the actuating element movable between a locking position and an actuation position and can be rotated only in the actuation position, the actuating element having a head constructed as a hexagon and a slimmer shank located underneath the head, the shank passable through an opening constructed as a slotted hole of a baseplate in such a manner that the head is held secured against rotation in the locking position inside the opening, and in the actuating position, the shank moveable into the area of the opening in order to rotate the actuation element.

2. Stock mounting device according to claim 1 wherein the clamping pin is arranged on the receiver and the clamping cam is arranged in the stock.

3. Stock mounting device according to claim 1 wherein the clamping cam is arranged in a front stock rotatably about an axis perpendicular to the longitudinal axis of the stock.

4. Stock mounting device according to claim 1 wherein the clamping cam is rotatably arranged on a baseplate inside a housing.

5. Stock mounting device according to claim 1 wherein the clamping cam has at least one eccentric tensioning face on its outer side for contact on a tightening face on the tensioning head of the clamping pin.

6. Stock mounting device according to claim 1 wherein the clamping pin is mounted via a mounting element on the receiver.

7. Stock mounting device according to claim 6 wherein the mounting element is arranged in a slot of a barrel housing, constructed in the form of a slotted sleeve, of the receiver.

8. Stock mounting device according to claim 7 wherein the mounting element is arranged in the slot so as to be pivotable between a stock mounting position and a barrel mounting position and is constructed like a wedge in such a manner that the barrel receptacle is widened in the barrel installation position.

9. Stock mounting device according to claim 8 wherein the mounting element contains lateral wedge faces for contact with a step-like shoulder in the slot.

10. Small arm with a stock mounting device for fixing a stock on a receiver of the small arm wherein the stock mounting device is constructed according to claim 1.

11. A stock mounting device for mounting a stock on a receiver for a small arm, the device comprising:

a clamping pin having a tensioning head and a slimmer area;

a clamping cam having a central through-hole for passage of the tensioning head of the clamping pin, the clamping cam further having at least one lateral slot for accommodating the slimmer area of the clamping pin;

a locking device, configured for preventing an undesired turning of the clamping cam, the locking device arranged on the clamping cam, the locking device including an axially movable actuating element connectable to the clamping cam, the actuating element:

movable between a locking position and an actuation position;

rotatable only in the actuation position;

having a head and a slimmer shank located underneath the head, the shank configured to be passable through an opening constructed as a slotted hole of a baseplate in such a manner that the head is held secured against rotation in the locking position inside the opening, and in the actuating position, the shank moveable into the area of the opening in order to rotate the actuation element.

* * * * *